US008045897B2

(12) United States Patent
Izumi et al.

(10) Patent No.: US 8,045,897 B2
(45) Date of Patent: Oct. 25, 2011

(54) DEVELOPING DEVICE

(75) Inventors: Takao Izumi, Yokohama (JP); Minoru Yoshida, Machida (JP); Hiroshi Murata, Yokohama (JP); Takashi Hatakeyama, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 82 days.

(21) Appl. No.: 12/550,639

(22) Filed: Aug. 31, 2009

(65) Prior Publication Data

US 2010/0067931 A1 Mar. 18, 2010

Related U.S. Application Data

(60) Provisional application No. 61/097,643, filed on Sep. 17, 2008.

(51) Int. Cl.
*G03G 15/08* (2006.01)

(52) U.S. Cl. ..... 399/257

(58) Field of Classification Search ..... 399/53, 399/254, 257, 260, 264
See application file for complete search history.

(56) References Cited

U.S. PATENT DOCUMENTS

| | | | | |
|---|---|---|---|---|
| 4,614,165 | A * | 9/1986 | Folkins et al. | 399/257 |
| 4,891,673 | A * | 1/1990 | Buell | 399/257 |
| 7,376,374 | B2 * | 5/2008 | Adachi | 399/254 |
| 7,383,002 | B2 * | 6/2008 | Murata et al. | 399/257 |
| 2008/0008502 | A1 * | 1/2008 | Hatakeyama et al. | 399/254 |
| 2009/0148192 | A1 * | 6/2009 | Hatakeyama et al. | 399/254 |

FOREIGN PATENT DOCUMENTS

JP 07-121017 5/1995

* cited by examiner

*Primary Examiner* — Sandra Brase
(74) *Attorney, Agent, or Firm* — Turocy & Watson, LLP

(57) ABSTRACT

A developing device includes a developer tank configured to contain a developer including a toner and a carrier, the developer tank having a discharge port which is provided in a lateral side surface of the developer tank and configured to discharge the developer, a developing agent supplier configured to develop a latent image by using the toner contained in the developer tank, and a plate-shaped member configured to be formed in a direction of height from a lower end of the discharge port and partially cover the discharge port to regulate the discharge of the developer.

18 Claims, 6 Drawing Sheets

DEVELOPING DEVICE

CROSS-REFERENCE TO RELATED APPLICATION

This application claims the benefit of U.S. Provisional Application No. 61/097,643, filed Sep. 17, 2008.

TECHNICAL FIELD

The present invention relates to a technique for maintaining the amount of developer in a developing device in an image forming apparatus at a constant level.

BACKGROUND

In an apparatus using an electrographic technique such as a copy machine, printer or facsimile, a developing device contains a developer including two components, that is, toner and carrier, for developing an electrostatic latent image on a photoconductor surface. The developing device supplies toner to the photoconductor surface.

In the case of a dry developer, the toner is consumed in the development of a latent image, whereas the carrier remains in the developing device. As for the carrier, the resin coating material on the surface may be separated or toner components may adhere to the surface. Such a carrier lowers charging capability of the developer and causes degradation in image characteristics.

To deal with this, a method of supplying a carrier as well as a toner to the developing device is proposed. In this method, unlike a method of totally replacing a developer in certain timing during its life, the carrier is supplied simultaneously with the toner during normal development. The toner is consumed in the development, whereas the supplied carrier remains within the developing device. If the toner density in the developing device is to be maintained at a constant level, the bulk of the developer in the developing device is increased. The developer that overflows the developing device is discharged outside the developing device. This method is a discharge method utilizing a so-called overflow.

JP-A-7-121017 discloses a method for maintaining toner density in a developing device at a constant level, utilizing an overflow of a developer. JP-A-7-121017 discloses a configuration in which a discharge port for discharging the developer is formed in the shape of an inverted triangle in the direction of the height of the developing device.

With the configuration disclosed in JP-A-7-121017, even if the amount of developer in the developer tank is suddenly increased, the developer can be quickly discharged outside the developing device by the amount of increase. Therefore, the amount of developer in the developer tank restores a standard amount.

However, characteristics including physical properties, fluidity and bulk density of the developer change depending on the environment and life (degradation of the developer with time). JP-A-7-121017 does not disclose whether the discharge port is configured to be capable of dealing with changes in fluidity of the developer or not. That is, with the configuration disclosed in JP-A-7-121017, the developer in the developer tank cannot be maintained in a standard mount if the fluidity of the developer is lowered. The developing device cannot sufficiently supply the developer to the developing roller. Therefore, the developing device has a problem that an uneven developer layer is formed on the developing roller.

Thus, the invention provides a developing device having a structure that can efficiently discharge a developer outside.

SUMMARY

According to one aspect of the present invention, there is provided a developing device including: a developer tank configured to contain a developer including a toner and a carrier, the developer tank having a discharge port which is provided in a lateral side surface of the developer tank and configured to discharge the developer; a developing agent supplier configured to develop a latent image by using the toner contained in the developer tank; and a plate-shaped member configured to be formed in a direction of height from a lower end of the discharge port and partially cover the discharge port to regulate the discharge of the developer.

DETAILED DESCRIPTION

Hereinafter, embodiments will be described with reference to the drawings.

Figure 1:
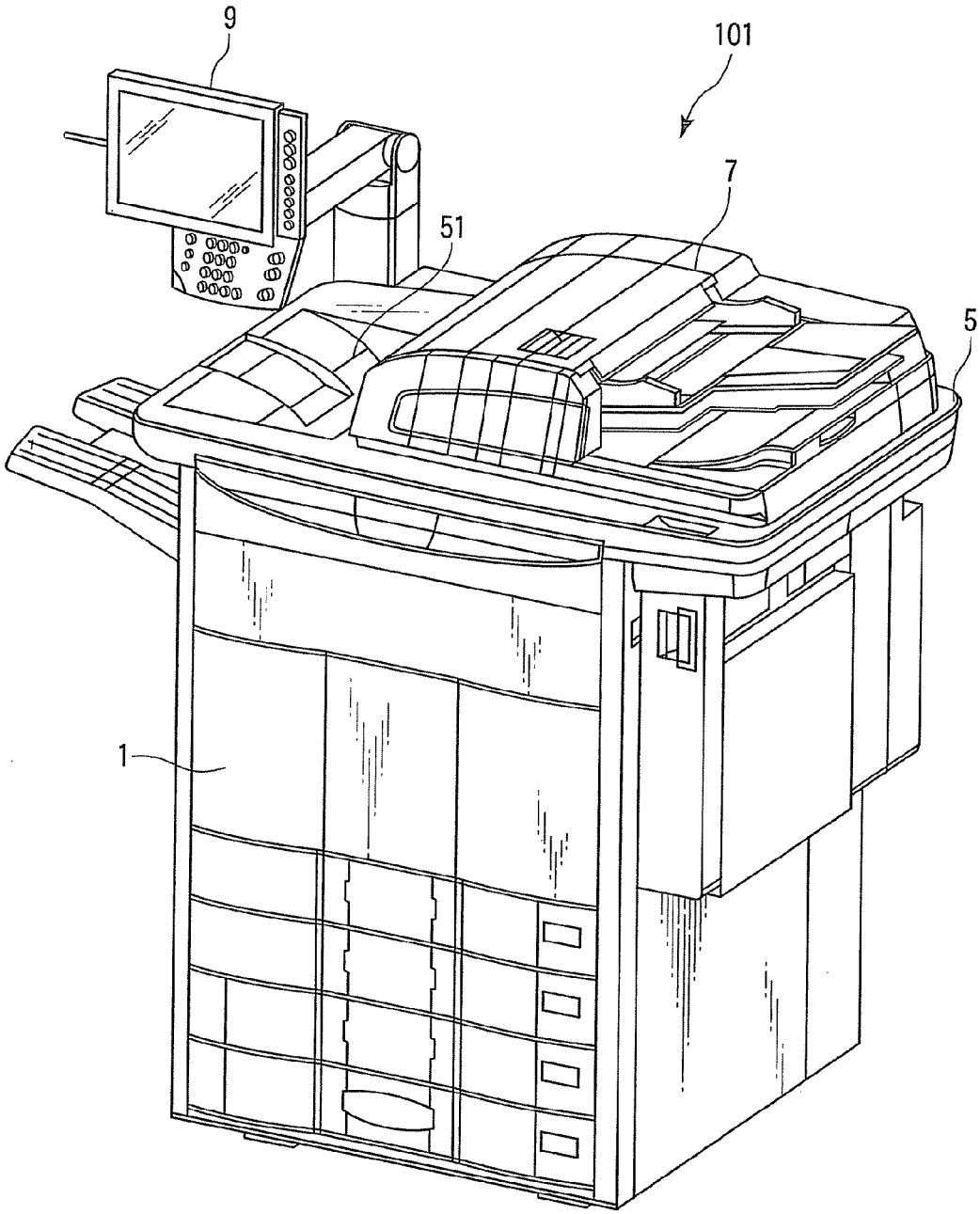
FIG. 1 is a perspective view showing the appearance of an image forming apparatus.

FIG. 1 is a perspective view showing the appearance of an image forming apparatus 101 according to an embodiment. The image forming apparatus 101 is, for example, a four-drum tandem color copy machine. The image forming apparatus 101 has an image forming unit 1, a sheet supply unit 3, and a scanner (image scanning unit) 5. The image forming unit 1 outputs image information, for example, as an output image referred to as hard copy or printout. The sheet supply unit 3 supplies a sheet of an arbitrary size used for image output, to the image forming unit 1. The image scanning unit 5 takes in image information as a target of image formation in the image forming unit 1, as image data from a document holding image information.

Above the image forming unit 1, an automatic document feeder 7 is provided which, if an original document is a sheet, discharges the document after scanning of image information by the image scanning unit 5 is finished to a discharge position from a scanning position and guides the next document to the scanning position. An instruction input unit for instructing the start of image formation by the image forming unit 1 and the start of scanning of image information of a document by the image scanning unit 5, that is, a display unit 9 as a control panel, is provided on the image forming apparatus 101.

Figure 2:
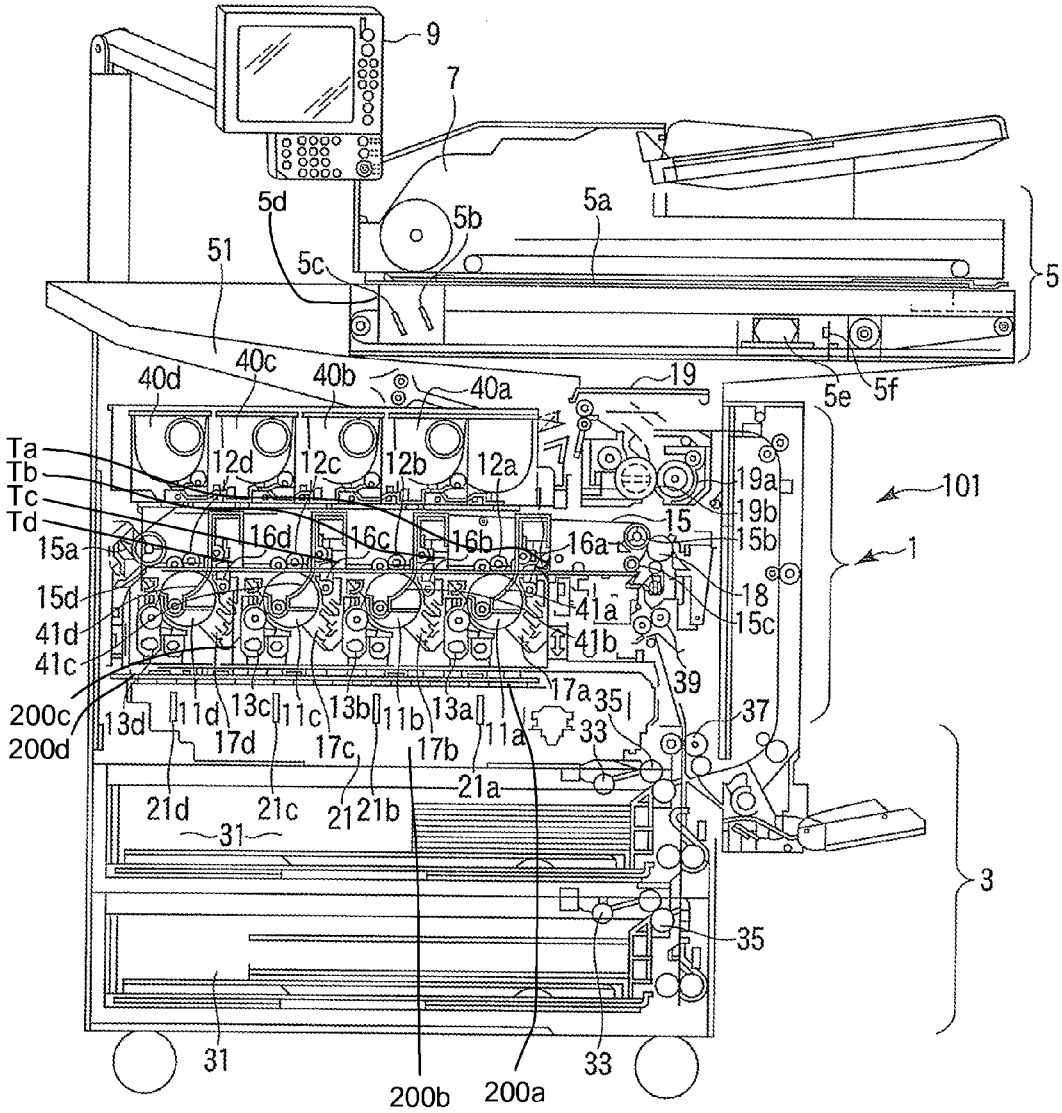
FIG. 2 is a schematic view showing the internal structure of the image forming apparatus as viewed from the front.

FIG. 2 is a schematic view showing the internal structure of the image forming apparatus 101 as viewed from the front. First, the structure of the image scanning unit 5 will be described. The image scanning unit 5 includes a transparent platen glass 5*a* for placing a document thereon, a light source 5*b* which irradiates the document with light, and a reflection mirror 5*c* which reflects the light reflected by the document. The light source 5*b* and the reflection mirror 5*c* are provided integrally in a document illumination unit 5*d* that is horizontally movable. The reflected light from the document illumination unit 5*d* is received by a CCD 5*f* via an imaging lens 5*e* arranged on the optical path.

Next, the configuration of the image forming unit 1 will be described. In an upper part of the image forming unit 1, toner cartridges 40*a* to 40*d* are provided in parallel. The toner cartridge 40*a* contains a developer including a yellow toner. The toner cartridge 40*b* contains a developer including a magenta toner. The toner cartridge 40*c* contains a developer including a cyan toner. The toner cartridge 40*d* contains a developer including a black toner. Here, the developer refers to a two-component developer made of a mixture of a toner of each color, for example, yellow toner, and a ferrite carrier. Below the toner cartridges 40*a* to 40*d*, toner hoppers 41*a* to 41*d* are provided in parallel. The toner cartridge 40*a* supplies the developer to the toner hopper 41*a*. The toner hopper 41*a* supplies the developer to a developing device 13*a*, which will be described later. The same applies to the toner hoppers 41*b* to 41*d*.

The image forming unit 1 has photoconductive drums 11*a* to 11*d*, developing devices 13*a* to 13*d*, an intermediate transfer belt 15, cleaners 16*a* to 16*d*, chargers 17*a* to 17*d*, and an exposure device 21. The photoconductive drums 11*a*, to 11*d* are image carriers that hold electrostatic latent images. The developing devices 13*a* to 13*d* carry out reversal development of the electrostatic latent images formed on the photoconductive drums 11*a* to 11*d*. The development device 13*a* contains a developer including a yellow toner. The development device 13*b* contains a developer including a magenta toner. The development device 13*c* contains a developer including a cyan toner. The development device 13*d* contains a developer including a black toner. The intermediate transfer belt 15 is a transfer target member that holds the toner images developed on the photoconductive drums 11*a* to 11*d*, in a sequentially stacked state. The cleaners 16*a* to 16*d* neutralize surface charges on the photoconductive drums 11*a* to 11*d* by uniform light irradiation. The cleaners 16*a* to 16*d* also remove the toners remaining the photoconductive drums 11*a* to 11*d* from the individual photoconductive drums 11*a* to 11*d* and contains the removed toners. The chargers 17*a* to 17*d* uniformly negatively charge the photoconductive drums 11*a* to 11*d*. The exposure device 21 includes LDs 21*a* to 21*d* which cast a laser beam modulated in accordance with writing image data to the photoconductive drums 11*a* to 11*d* and form electrostatic latent images. The exposure device 21 may also include LEDs or the like.

The photoconductive drum 11*a*, the developing device 13*a*, the cleaner 16*a*, the charger 17*a* and the LD 21*a* form a process unit 200*a*. The process unit 200*a* is configured with a layout centering the photoconductive drum 11*a*. On the periphery of the photoconductive drum 11*a*, in the rotating direction of the photoconductive drum 11*a*, the LD 21*a* is provided downstream of the charger 17*a* and the developing device 13*a* is provided downstream of the LD 21*a*. The photoconductive drum 11*a* is provided to contact the intermediate transfer belt 15. The cleaner 16*a* is provided downstream of the places where the intermediate transfer belt 15 contacts the photoconductive drums 11*a* to 11*d* (primary transfer unit).

In the process unit 200*a*, as the charger 17*a* charges the photoconductive drum 11*a*, one cycle of transfer to the intermediate transfer belt 15 is started. In the process unit 200*a*, as the photoconductive drum 11*a* rotates, the cleaner 16*a* removes the toner. Thus, the one cycle of transfer to the intermediate transfer belt 15 is completed. As the charger 17*a* uniformly charges the uncharged photoconductive drum 11*a*, the process unit 200*a* starts a next cycle of transfer to the intermediate transfer belt 15.

In the image forming unit 1, a process unit 200*b*, a process unit 200*c* and a process unit 200*d* are provided including the photoconductive drum 11*b*, the photoconductive drum 11*c* and the photoconductive drum 11*d*, similarly to the process unit 200*a*. Therefore, the four process units are provided in the image forming unit 1.

The image forming unit 1 further includes a transfer device 18 and a fixing device 19. The transfer device 18 is a secondary transfer unit which transfers toner images stacked on the intermediate transfer belt 15 to a sheet. The fixing device 19 fixes the toner images transferred to the sheet, to the sheet.

The intermediate transfer belt 15 is stretched by a driving roll 15*a*, a backup roll 15*b*, and a tension roll 15*c*. The driving roll 15*a* turns the intermediate transfer belt 15. The backup roll 15*b* is a secondary transfer roller. The tension roll 15*c* maintains tension applied to the intermediate transfer belt 15 at a constant level. In the part where the driving roll 15*a* is provided on the intermediate transfer belt 15, a belt cleaner 15*d* is arranged to contact the intermediate transfer belt 15 at a position facing the driving roll 15*a* with the intermediate transfer belt 15 held between the driving roll 15*a* and the belt cleaner 15*d*. The intermediate transfer belt 15 has a width substantially equal to the dimension of the photoconductive drums 11*a* to 11*d*, in a direction orthogonal to the carrying direction. The intermediate transfer belt 15 is in the shape of a seamless belt.

The intermediate transfer belt 15 is made of 100-μm thick polyimide resin in which carbon is uniformly dispersed. The intermediate transfer belt 15 has an electric resistance of $10^9$ Ωcm. The intermediate transfer belt 15 is semiconductive. The intermediate transfer belt 15 may be made of any semiconductive material having a volume resistivity of $10^8$ to $10^{11}$ Ωcm. For example, the intermediate transfer belt 15 may be made of polyethylene terephthalate, polycarbonate, polytetrafluoroethylene, poly(vinylidene fluoride) or the like in which conductive particles such as carbon are dispersed. A high polymer film with electric resistance adjusted by composition adjustment may also be used for the intermediate transfer belt 15. The intermediate transfer belt 15 may also be made of a high polymer film mixed with an ionic conductive substance, or a rubber material such as silicone rubber or urethane rubber having a relatively low electric resistance.

In the primary transfer unit, primary transfer rolls 12*a* to 12*d* as transfer devices are arranged on the back side of the intermediate transfer belt 15 in such a manner that the primary transfer rolls 12*a* to 12*d* are pressed in contact with the photoconductive drums 11*a* to 11*d* via the intermediate transfer belt 15. That is, the primary transfer rolls 12*a* to 12*d* are provided to face and contact the process units 200*a* to 200*d* via the intermediate transfer belt 15. Moreover, the primary transfer roll 12*a* is connected to a positive DC power source, not shown. The primary transfer rolls 12*b* to 12*d* are similar to the primary transfer roll 12*a*.

The transfer device 18 is arranged to contact the toner carrying side of the intermediate transfer belt 15. Moreover, the transfer device 18 faces the backup roll 15*b* arranged on the back side of the intermediate transfer belt 15. The backup roll 15*b* has a counter-electrode with the transfer device 18.

Next, color image formation in the image forming apparatus 101 will be described. As an instruction to start image formation is inputted to the image forming apparatus 101, the photoconductive drum 11*a* receives a driving force from a driving mechanism, not shown, and starts rotating. The photoconductive drum 11*a* is cylindrical with a diameter of 30 mm. The charger 17*a* uniformly charges the photoconductive drum 11*a* to approximately −600 V. The LD 21*a* casts light corresponding to an image to be recorded and thus forms an electrostatic latent image on the photoconductive drum 11*a*.

The developing device 13*a* provides a bias value −380 V to a developing sleeve, not shown, by using a developing bias power source, not shown, and thus forms a developing electric field between the developing sleeve and the photoconductive drum 11*a*. The developing electric field is in a direction toward the developing sleeve of the developing device 13*a* from the surface of the photoconductive drum 11*a*. The yellow toner, which is contained in the developing device 13*a* and negatively charged, adheres to an area of image part potential (high potential part) of the electrostatic latent image on the photoconductive drum 11*a*. The structure of the developing device 13*a* will be later described in detail.

Next, the developing device 13*b* develops an electrostatic latent image and forms a magenta toner image on the photoconductive drum 11*b*, using a different method from the formation of the yellow toner image on the photoconductive drum 11*a* by the developing device 13*a*. The magenta toner has a volume average particle diameter of 7 μm similarly to the yellow toner. The magenta toner is negatively charged by frictional charging with ferrite magnetic carrier particles having a volume average particle diameter of about 50 μm. The average amount of charging of the magenta toner is about −30 μC/g. The developing device 13*b* provides a bias value −380 V to a developing sleeve, not shown, by using a developing bias power source, not shown, and thus forms a developing electric field between the developing sleeve and the photoconductive drum 11*b*. The negatively charged magenta toner adheres to an area of high potential part of the electrostatic latent image on the photoconductive drum 11*b*.

In a transfer area Ta formed by the photoconductive drum 11*a*, the intermediate transfer belt 15 and the primary transfer roll 12*a* in the process unit 200*a*, a bias voltage of about +1000 V is applied to the primary transfer roll 12*a* from a DC power source. A transfer electric field is formed between the primary transfer roll 12*a* and the photoconductive drum 11*a*. The yellow toner image on the photoconductive drum 11*a* is transferred onto the intermediate transfer belt 15 according to the transfer electric field.

The primary transfer roll 12*a* will be described further in detail. The primary transfer roll 12*a* is a conductive urethane foam roller that is made conductive by dispersion of carbon therein. The primary transfer roll 12*a* includes a roller having an outer diameter of 18 mm on a core metal having a diameter of 10 mm. The electric resistance between the core metal and the roller surface is about $10^6\Omega$. A constant-voltage DC power source, not shown, is connected to the core metal. The power supply device in the primary transfer roll 12*a* is not limited to a roller but may be a conductive brush, conductive rubber blade, conductive sheet or the like. The conductive sheet may be a carbon-dispersed rubber material or resin film. The conductive sheet may be a rubber material such as silicone rubber, urethane rubber or EPDM, or a resin material such as polycarbonate. It is desirable that the conductive sheet has a volume resistivity of $10^5$ to $10^7$ Ωcm.

A pair of springs is provided at both ends of the primary transfer roll 12*a*. The primary transfer roll 12*a* is energized by the pair of springs to vertically elastically contact the intermediate transfer belt 15. The magnitude of the energizing force of the pair of springs provided on primary transfer roll 12*a* is 600 gft. The energizing force of one spring of the spring pair is 300 gft. The configuration of the primary transfer rolls 12*b* to 12*d* is similar to that of the primary transfer roll 12*a*. Also, the configuration of elastic contact to the intermediate transfer belt 15 is the same. Therefore, these configurations will not be described further in detail.

The intermediate transfer belt 15 to which a yellow toner image is transferred in the transfer area Ta is carried toward a transfer area Tb. In the transfer area Tb in the process unit 200*b*, a bias voltage of about +1200 V is applied to the primary transfer roll 12*b* from a DC power source. A magenta toner image on the photoconductive drum 11*b* is transferred onto intermediate transfer belt 15 to overlap the yellow toner image in accordance with the transfer electric field. In a transfer area Tc in the process unit 200*c*, a bias voltage of about +1400 V is applied to the primary transfer roll 12*c* from a DC power source. A cyan toner image on the photoconductive drum 11*c* is transferred onto the intermediate transfer belt 15 to overlap the yellow toner image and the magenta toner image in accordance with the transfer electric field. In a transfer area Td in the process unit 200*d*, a bias voltage of about +1600 V is applied to the primary transfer roll 12*d* from a DC power source. A black toner image on the photoconductive drum 11*d* is transferred onto the intermediate transfer belt 15 to overlap the yellow toner image, the magenta toner image and the cyan toner image in accordance with the transfer electric field. In this manner, multiple-transferred toner images are transferred onto the intermediate transfer belt 15.

When the transfer device 18 transfers toner images to a sheet, the sheet supply unit 3 supplies a sheet to the transfer device 18 in predetermined timing. Cassettes set in plural cassette slots 31 house sheets of arbitrary sizes. According to image formation, a pickup roller 33 takes out a sheet. The size of a sheet corresponds to the size of a toner image formed by the image forming unit body 1. A separation mechanism 35 prevents two or more sheets from being taken out by the pickup roller 33. Plural carrying rollers 37 carry the sheet that is limited as a single sheet by the separation mechanism 35, toward a registration roller pair 39. The registration roller pair 39 sends the sheet to a transfer position where the transfer device 18 contacts the intermediate transfer belt 15, in timing when the transfer device 18 transfers the toner image from the intermediate transfer belt 15. As for the cassette slots 31, the pickup roller 33 and the separation mechanism 35, plural units of these parts are prepared according to the need and the cassettes are arbitrarily removable from and attachable to different slots.

The backup roll 15*b* and the transfer device 18 transfer the toner image of plural colors transferred to the intermediate transfer belt 15, to a sheet of paper or the like in the second transfer unit. A predetermined bias is applied to the transfer device 18. The transfer device 18 forms a transfer electric field between the transfer device 18 and the backup roll 15*b* with the intermediate transfer belt 15 nipped between the two rollers. The transfer device 18 and the backup roll 15*b* collectively transfer the multi-color toner image on the intermediate transfer belt 15 to the sheet.

The sheet to which image information is fixed via the fixing device 19 is discharged to a paper discharge tray 51 situated to the lateral side of the image scanning unit 5 and above the image forming unit body 1. Here, the fixing device 19 has a fixing roller 19*a* and a pressurizing roller 19*b* downstream in the paper discharge direction. On the sheet to which the toner image is transferred, the toner image is melted by the temperature-raised fixing roller 19*a* and pressurizing roller and the image information is thus fixed.

Figure 3:
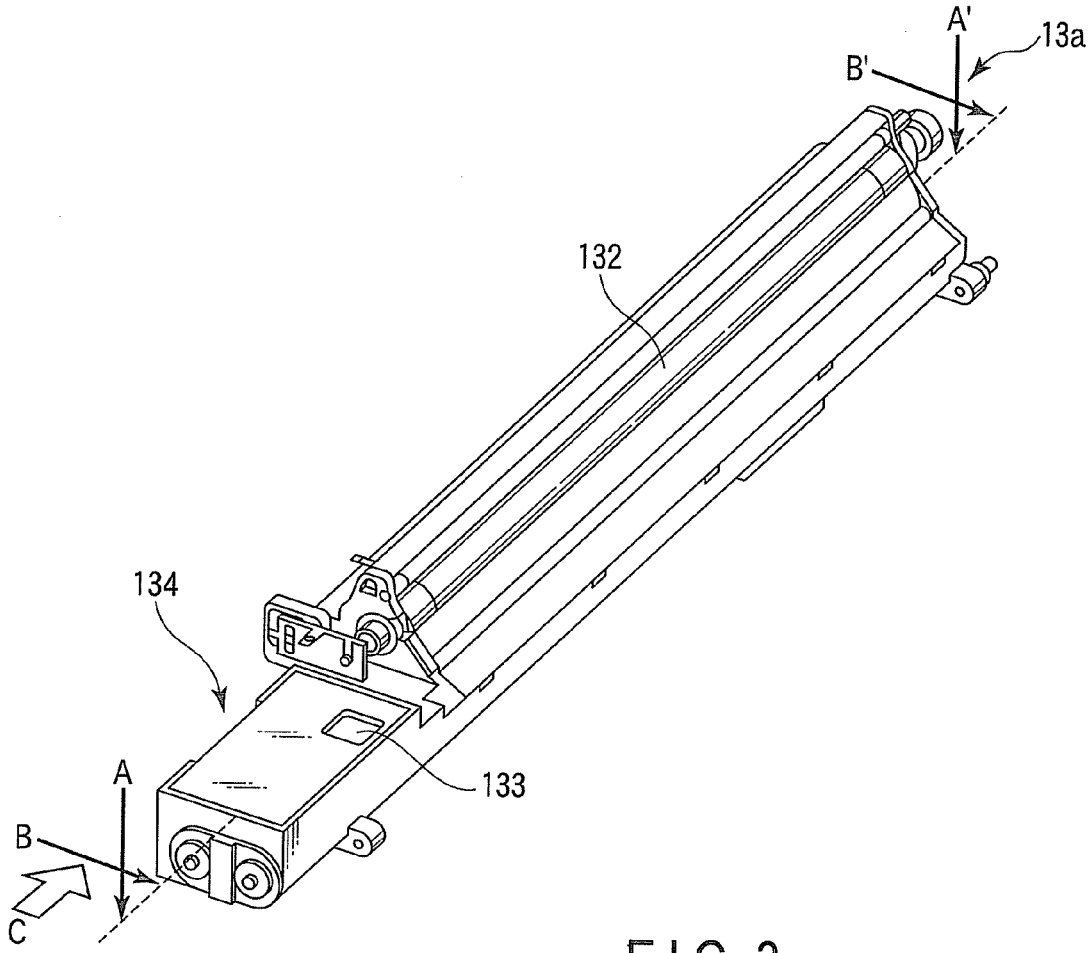
FIG. 3 is a perspective view of a developing device.
Figure 4:
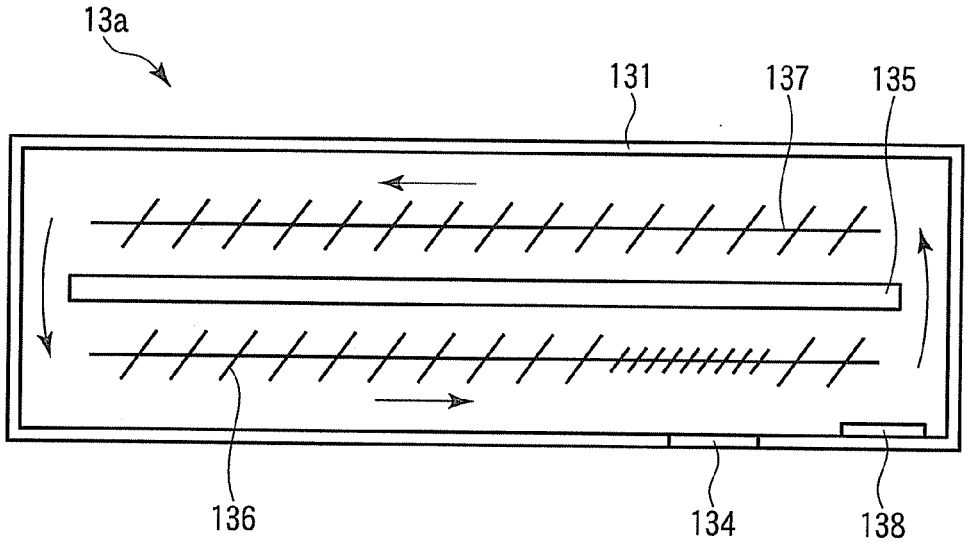
FIG. 4 is a top sectional view in the longitudinal direction of the developing device.
Figure 5:
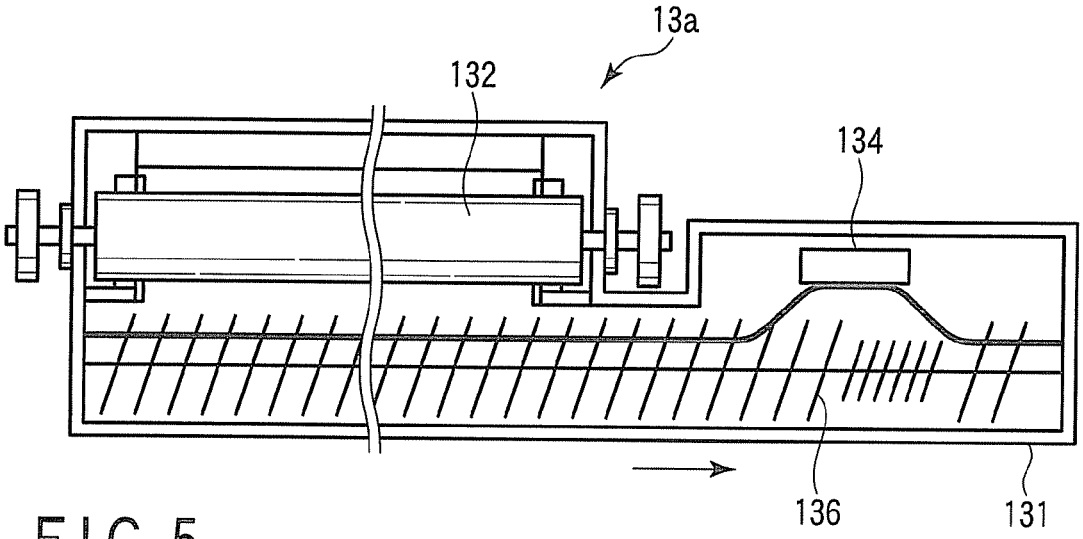
FIG. 5 is a lateral sectional view in the longitudinal direction of the developing device.
Figure 6:
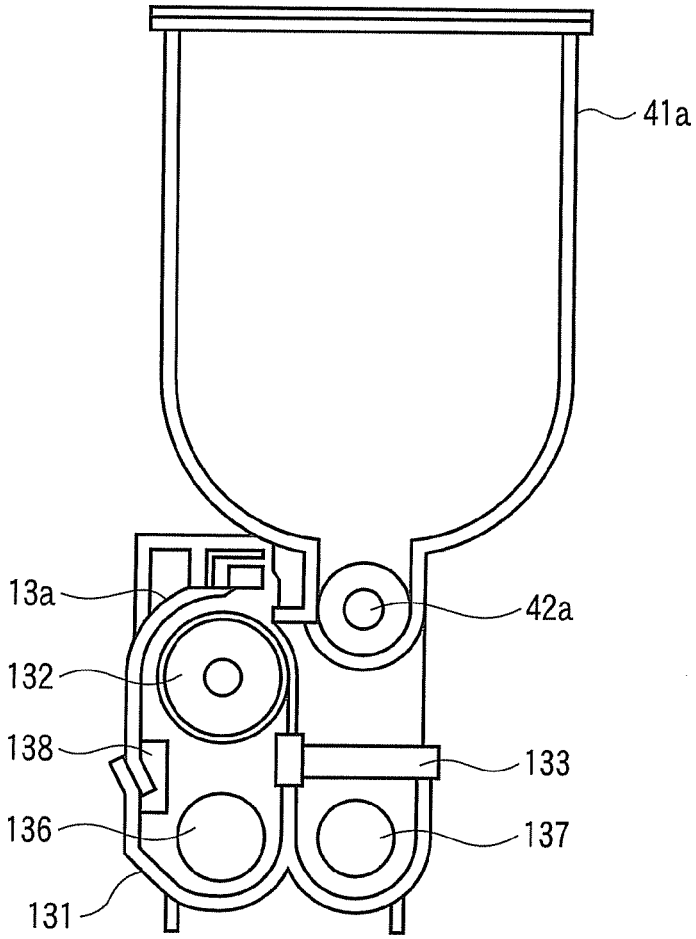
FIG. 6 is a plan view of the developing device.

Next, the structure of the developing device 13*a* according to the embodiment will be described. FIG. 3 is a perspective view of the developing device 13*a*. FIG. 4 is a top sectional view in A-A' in the longitudinal direction of the developing device 13*a* shown in FIG. 3. FIG. 5 is a lateral sectional view in B-B' in the longitudinal direction of the developing device 13*a* shown in FIG. 3. FIG. 6 is a view of the developing device 13*a* as viewed from the direction of arrow C in FIG. 3. While the developing device 13*a* will be described hereinafter, the same applies to the developing devices 13*b* to 13*d*.

As shown in FIG. 3, the developing device 13*a* has a developer tank 131, a developing roller 132, a replenishment port 133, and a discharge port 134. The developer tank 131 contains a developer. The developing roller 132 as a developing agent supplier is rotatably provided. The developing roller 132 is arranged to face the photoconductive drum 11*a*. As the developing roller 132 rotates itself, the toner and carrier contained in the developer tank 131 are supplied to the developing roller 132.

The replenishment port 133 is provided on the top side of the developer tank 131. Through the replenishment port 133, the developer including yellow toner is supplied to the developer tank 131 via the toner hopper 41*a* from the toner cartridge 40*a*. The discharge port 134 is provided on a lateral side of the developer tank 131. Through the discharge port 134, the developer contained in the developer tank 131 is discharged by an overflow. The discharge port 134 is rectangular and has a long side in the direction parallel to the longitudinal direction of the developer tank 131 and a short side in the direction of height orthogonal to the longitudinal direction of the developer tank 131.

In the developer tank 131, as shown in FIG. 4, a partition board 135, a first mixer 136, a second mixer 137, and a toner density detector 138 are provided. The developer tank 131 is divided into two spaces in the longitudinal direction by the partition board 135. The two spaces are connected to each other at both ends in the longitudinal direction of the developer tank 131.

The first mixer 136 and the second mixer 137 are provided in the longitudinal direction of the developer tank 131. The first mixer 136 and the second mixer 137 rotate and thereby stir and carry the developer in the developer tank 131. The first mixer 136 carries the developer in the longitudinal direction of the developer tank 131 in the direction opposite to the direction of carrying the developer by the second mixer 137. Therefore, the developer circulates in the direction of the arrows in the two spaces within the developer tank 131.

The replenishment port 133 shown in FIG. 3 is provided at a position in the developer tank 131 that faces the second mixer 137. That is, the developer is supplied into the space in the developer tank 131 where the second mixer 137 is provided. The developing roller 132 shown in FIG. 3 is provided at a position in the developer tank 131 that faces the first mixer 136. The space in the developer tank 131 where the first mixer 136 is provided is a developer carrying path on the side of the developing roller 132. The toner density detector 138 is provided in the space in the developer tank 131 where the first mixer 136 is provided. The toner density detector 138 detects the toner density of the developer carried by the first mixer 136.

The developing roller 132 is provided from one end to a part substantially close to the center in the longitudinal direction of the developer tank 131, as shown in FIG. 5. The discharge port 134 is provided toward the other end of the developer tank 131 where the developing roller 132 is not provided. In the direction in which the developer flows, the developing roller 132 is on the upstream side and the discharge port 134 is on the downstream side. The height of the developer tank 131 in the direction of height between the developing roller 132 and the discharge port 134 is made lower than at other positions. The first mixer 136 has a smaller screw diameter and a narrower pitch at a position near the discharge port 134.

The flow speed of the developer in the developer tank 131 is lowered near the discharge port 134 because of the shape of the developer tank 131 and the first mixer 136. The flow speed of the developer on the side where the discharge port 134 is provided is lower than the flow speed of the developer on the side where the developing roller 132 is provided. Therefore, if the developer flows in the direction of the arrow shown in FIG. 5, the surface of the developer (indicated by the bold solid line in FIG. 5) flowing in the developer tank 131 bulges to form a mound on the side where the discharge port 134 is provided in the developer tank 131.

The discharge port 134 is provided in such a manner that in accordance with the shape of the developer tank 131 and the first mixer 136 and the rotation speed of the first mixer 136, the top part of the mound of the developer surface coincides with the lower end of the center of the discharge port 134 in the state where the standard amount of the developer is contained in the developer tank 131. Therefore, the developer surface does not fluctuate at the lower end of the center of the discharge port 134. Moreover, when the developer is newly supplied to the developing device 13*a* via the toner hopper 41*a* from the toner cartridge 40*a*, the developer in the developer tank 131 overflows from the discharge port 134 and is stably discharged outside the developer tank 131 by the amount of the supplied developer.

Here, as shown in FIG. 6, the developer is supplied to the developing device 13*a* via the replenishment port 133 from the toner cartridge 40*a* if the toner density detector 138 detects that the toner density in the developing device 13*a* is lower than a predetermined value. As the developing device 13*a* develops an electrostatic latent image formed on the photoconductive drum 11*a* with the toner, the toner density in the developing device 13*a* is lowered. The toner density detector 138 detects whether the toner density in the developing device 13*a* is lower than a predetermined value or not. If it is detected that the developer in the developing device 13*a* is reduced in accordance with the output from the toner density detector 138, the toner hopper 41*a* supplies the developer to the developing device 13*a* via the replenishment port 133 by a supply roller 42*a*.

The toner density in the developing device 13*a* is maintained at a constant level as the toner is supplied into the developing device 13*a* from the toner hopper 41*a*. The developing device 13*a* is also supplied with the carrier at the same as the toner from the toner cartridge 40*a*. The developer in the developer tank 131 overflows and is discharged from the discharge port 134 by the amount of the supplied developer. Therefore, the amount of the developer in the developer tank 131 is maintained at a constant level. Moreover, in the developer tank 131, the old degraded carrier is discharged from the discharge port 134 and is gradually replaced with a new carrier.

Next, the developer will be described. As the developer in this embodiment, a two-component developer including a toner and a magnetic carrier is used. The toner includes a binding resin and a coloring agent as principal components. The binding resin may be polystyrene, styrene acrylic copolymer, polyester, epoxy resin, silicone resin, polyamide, paraffin wax or the like. As the coloring agent, a pigment and dye may be used. Carbon black, aniline blue, pigment red, pigment yellow or the like may be used. Additionally, a charge control agent, cleaning adjuvant, release enhancer, fluidity enhancer or the like may be contained if necessary.

As the carrier, magnetic particles such as ferrite or iron oxide can be used, or these materials may be used as a core material and may be coated with a resin. As the resin that coats the carrier, a fluorine resin, acrylic resin, silicone resin or the like can be used. These resins can be used singly or a combination of plural kinds of resins can be used as well. A resin containing magnetic powder may also be used.

The developer for replenishment will now be described. The two-component developer made of a mixture of toner and carrier is prepared by a mixing device. As the mixing device, a Henschel mixer or the like is used. The developer for replenishment is mostly a toner and is mixed with a small amount of carrier.

The developer to be supplied includes the toner and carrier as described above. Here, the toner is consumed in the image formation, whereas the carrier remains in the developer tank 131 of the developing device 13*a*. Therefore, if the toner density of the developer in the developer tank 131 is to be maintained at a constant level, the amount of the developer in the developer tank 131 is increased by the supply of the developer. The excess developer in the developer tank 131 overflows from the developer discharge port 134 for discharge of the developer provided in the wall of the developer tank 131 and is discharged outside the developer tank 131. As the supply and discharge of the developer is sequentially repeated in this manner, the old developer in the developer tank 131 is replaced by the newly supplied developer. In the developer tank 131, the properties of the developer are maintained satisfactorily by such supply and discharge of the developer, and the amount of the developer is thus maintained at a constant level. However, the amount of the developer discharged by an overflow is easily influenced by the physical properties of the developer.

If the fluidity of the developer is extremely lowered, the mound-shaped developer surface at the lower end of the discharge port 134 becomes higher. The developer surface on the side where the developing roller 132 is provided becomes relatively lower. Therefore, the developing roller 132 cannot be sufficiently supplied with the developer from the developer tank 131. Consequently, an uneven developer layer is formed on the developing roller 132.

Figure 7A:
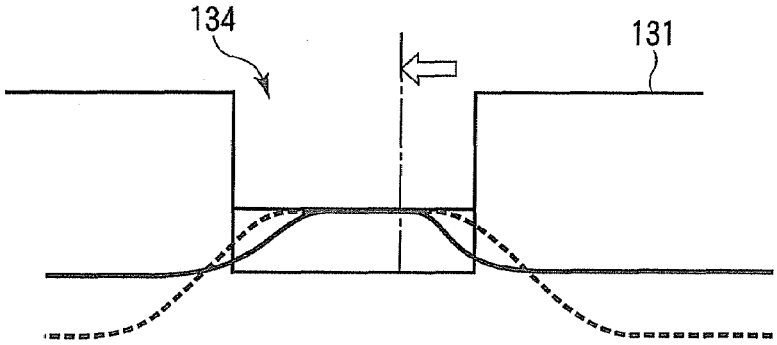
FIG. 7A is a side view of a developing device as a comparative example.
Figure 7B:
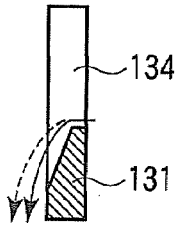
FIG. 7B is a front sectional view of the dotted chain line part in FIG. 7A, as viewed from the direction of the arrow.

FIG. 7A and FIG. 7B show the discharge port 134 of the developing device 13*a*. FIG. 7A and FIG. 7B show the developing device 13*a* where nothing is provided in the discharge port 134, as a comparative example. FIG. 7A is a side view of the developing device 13*a*. FIG. 7B is a front sectional view in the chain dotted line in FIG. 7A as viewed from the direction of the arrow.

The discharge port 134 has a width of 10 mm in the longitudinal direction of the developer tank 131. The lower end of the discharge port 134 has a trapezoidal cross section in the direction of width of the developer tank 131 having a downward inclination with respect to the direction of height of the developer tank 131, as shown in FIG. 7B.

The bold solid line shows the developer surface height near the discharge port 134, of the developer that is initially put into the developer device 13*a* (developer A). The bold broken line shows, for example, the developer surface height of the developer after printing equivalent to 300 k sheets without replacing the developer A contained in the developing device 13*a* (developer B).

Figure 13:
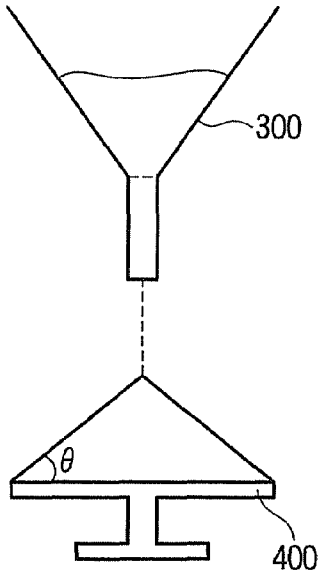
FIG. 13 shows a configuration for measuring the angle of repose of a developer.

The developer A and the developer B are different in fluidity. The difference in fluidity between the developer A and the developer B can be expressed by using the angle of repose. Here, a method of measuring the angle of repose of the developer will be described. FIG. 13 shows a configuration to measure the angle of repose of the developer. First, the developer is dropped to the center of a flat table 400 from a funnel 300. The developer is deposited in a conical shape on the flat table 400. Here, it is assumed that the angle of inclination of the cone to the flat table 400 is θ. If the developer is further deposited on the flat table 400, the developer spills from the flat table 400 and the cone collapses. The angle of inclination θ of the cone at this point is the angle of repose of the developer. The angle of repose of the developer A is 36 degrees. The angle of repose of the developer B is 41 degrees.

The developer B has a larger angle of repose than the developer A. Therefore, even if the standard amount of the developer B is contained in the developer tank 131, the developer surface at the lower end of the center of the discharge port 134 is higher than the lower end of the center of the discharge port 134. Thus, a large amount of the developer B is discharged outside the developing device 13*a* from the discharge port 134. Consequently, the developer surface height of the developer B below the developing roller 132 becomes lower than the developer surface height of the developer A below the developing roller 132.

Here, to clarify evaluation indices, the developing device 13*a* containing the developer A and the developing device 13*a* containing the developer B are driven by using a driving device that can drive the first mixer 136 and the second mixer 137 of the developing device 13*a* at the same number of rotations.

First, the developer is gradually put into the developing device 13*a* from the replenishment port 133. Next, the developing device 13*a* stops input of the developer when the developer starts to be discharged from the discharge port 134. The developing device 13*a* waits until the discharge of the developer from the discharge port 134 stops, and then stops driving the first mixer 136 and the second mixer 137. The amount of developer at this time and the space in the direction of height between the developing roller 132 and the lowest part of the developer surface are measured and used as indices.

Here, the indices are measured in an environment of 23° C. and 50% using the initial developer A (with a toner density of 8.5%) in the developing device 13*a* having the discharge port 134 with the shape shown in FIG. 7A. The amount of the developer A contained in the developer tank 131 is 390 g. If the developer A is contained in the developer tank 131, the space in the direction of height between the developing roller 132 and the developer surface is 6 mm.

Moreover, the indices are measured in an environment of 23° C. and 50% using the developer B after printing equivalent to 300 k sheets in the developing device 13*a* having the discharge port 134 with the shape shown in FIG. 7A. The amount of the developer B contained in the developer tank 131 is 260 g. If the developer B is contained in the developer tank 131, the space in the direction of height between the developing roller 132 and the developer surface is 12 mm.

Figure 8A:
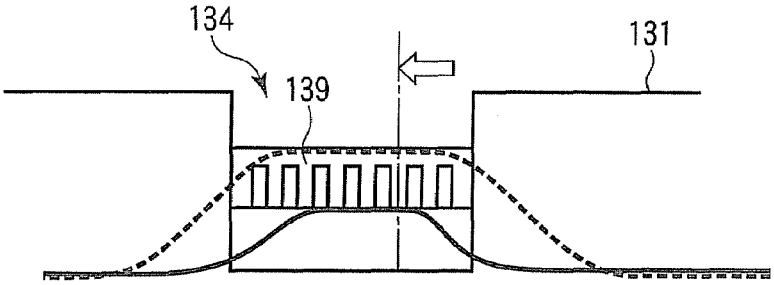
FIG. 8A is a side view of a developing device as a first embodiment.
Figure 8B:
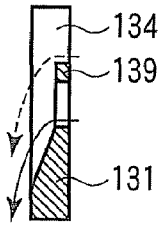
FIG. 8B is a front sectional view of the dotted chain line part in FIG. 8A, as viewed from the direction of the arrow.

Next, the developing device 13*a* according to a first embodiment will be described. FIG. 8A is a side view of the developing device 13*a*. FIG. 8B is a front sectional view in the chain dotted line in FIG. 8A as viewed from the direction of the arrow.

In the developing device 13*a* according to the first embodiment, a 4.0-mm slit plate 139 is provided in the direction of height of the developer tank 131 from the lower end of the discharge port 134. The slit plate 139 has a predetermined thickness in the direction of width of the developer tank 131. The slit plate 139 has plural slits having a height smaller than the height of the slit plate 139 in the direction of height of the developer tank 131 from the lower end of the discharge port 134. In the slit plate 139, plural slits having a slit width of 0.5 mm and a slit spacing of 0.5 mm are provided in the longitudinal direction of the developer tank 131. The upper end of the slit plate 139 is at a position lower than the upper end of the discharge port 134. That is, the lower end of the discharge port 134 is covered by the slit plate 139 and the upper end side of the discharge port 134 is perfectly open.

In the state where the fluidity of the developer is not lowered, the developer A is discharged from the part of the discharge port 134 where the slit plate 139 is provided, in accordance with the supply of the supplied developer. In the state where the fluidity of the developer is lowered, even if the standard amount of the developer B is contained in the developer tank 131, the developer surface in the discharge port 134 rises.

However, the developer B with the lowered fluidity has a characteristic that the developer cannot easily pass through a narrow space. The developer B is not discharged from the part of the discharge port 134 where the slit plate 139 is provided. The developer B is discharged from a position over the upper end of the slit plate 139. Therefore, the slit plate 139 has the same effect as raising the lower end of the discharge port 134 in the direction of height with respect to the developer B. In the developing device 13*a* according to the first embodiment, as the slit plate 139 is provided in the discharge port 134, reduction in the amount of developer contained in the developer tank 131 can be restrained.

Here, the indices are measured in an environment of 23° C. and 50% using the initial developer A (with a toner density of 8.5%) in the developing device 13*a* having the slit plate 139 provided in the discharge port 134. The amount of the developer A contained in the developer tank 131 is 390 g. If the developer A is contained in the developer tank 131, the space in the direction of height between the developing roller 132 and the developer surface is 6 mm.

Moreover, the indices are measured in an environment of 23° C. and 50% using the developer B after printing equivalent to 300 k sheets in the developing device 13*a* having the slit plate 139 provided in the discharge port 134. The amount of the developer B contained in the developer tank 131 is 380 g. If the developer B is contained in the developer tank 131, the space in the direction of height between the developing roller 132 and the developer surface is 6.5 mm. The indices for the developer B are substantially the same as the indices for the developer A.

As for the slit width of the slits provided in the slit plate 139, 2.0 mm, 1.0 mm, 0.2 mm and 0.1 mm other than the above 0.5 mm are tried. The slit width and the slit spacing are the same. As a result, if the slit width is 1.0 mm or greater (if the slit width is too broad), the developer B is discharged from the vicinity of the lower end of the slits (the lower end of the discharge port 134) as in the case of the developer A. The developing device 13*a* in which the slit plate 139 having a slit width of 1.0 mm or greater is provided in the discharge port 134 is in a state similar to the comparative example. The effect of the slit plate 139 is insufficient.

If the slit width is 0.1 mm (if the slit width is too narrow), the developer A is discharged from above the slit plate 139, similarly to the developer B. In the developing device 13*a* in which the slit plate 139 having a slit width of 0.1 mm is provided in the discharge port 134, a portion where a developer layer cannot be formed on the developing roller 132 is confirmed even if the developer A is contained.

Figure 9A:
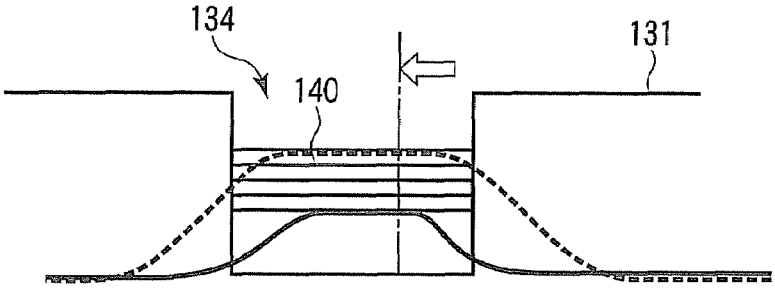
FIG. 9A is a side view of a developing device as a second embodiment.
Figure 9B:
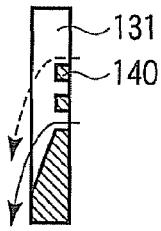
FIG. 9B is a front sectional view of the dotted chain line part in FIG. 9A, as viewed from the direction of the arrow.

Next, the developing device 13*a* according to a second embodiment will be described. FIG. 9A is a side view of the developing device 13*a*. FIG. 9B is a front sectional view in the chain dotted line in FIG. 9A as viewed from the direction of the arrow.

In the developing device 13*a* according to the second embodiment, a 4.0-mm slit plate 140 is provided in the direction of height of the developer tank 131 from the lower end of the discharge port 134. The slit plate 140 has plural slits in the longitudinal direction of the developer tank 131. The slit width in the slit plate 140 is the same as the width of the discharge port 134 in the longitudinal direction of the developer tank 131.

In the second embodiment, the slit plate 140 has plural slits at a slit spacing of 0.5 mm, with each slit having a width of 10 mm in the longitudinal direction of the developer tank 131 and a height of 0.5 mm in the direction of height of the developer tank 131. The upper end of the slit plate 140 is at a position lower than the upper end of the discharge port 134. That is, the lower end of the discharge port 134 is covered by the slit plate 140 and the upper end side of the discharge port 134 is perfectly open.

The slit plate 140 according to the second embodiment has the same effect as in the case where the lower end of the discharge port 134 is raised in the direction of height with respect to the developer with lowered fluidity, similarly to the slit plate 139 according to the first embodiment. In the developing device 13*a* according to the second embodiment, as the slit plate 140 is provided in the discharge port 134, reduction in the amount of developer contained in the developer tank 131 can be restrained.

Here, the indices are measured in an environment of 23° C. and 50% using the initial developer A (with a toner density of 8.5%) in the developing device 13*a* having the slit plate 140 provided in the discharge port 134. The amount of the developer A contained in the developer tank 131 is 390 g. If the developer A is contained in the developer tank 131, the space in the direction of height between the developing roller 132 and the developer surface is 6 mm.

Moreover, the indices are measured in an environment of 23° C. and 50% using the developer B after printing equivalent to 300 k sheets in the developing device 13*a* having the slit plate 140 provided in the discharge port 134. The amount of the developer B contained in the developer tank 131 is 370 g. If the developer B is contained in the developer tank 131, the space in the direction of height between the developing roller 132 and the developer surface is 7.0 mm.

The space between the developing roller 132 and the developer surface in the case where the developer B is contained in the developer tank 131 is slightly greater than the space between the developing roller 132 and the developer surface in the case where the developer A is contained in the developer tank 131. However, if the developer B is contained in the developing device 13*a*, the developer layer on the developing roller 132 is formed without any problem, as in the case of the developer A.

As for the slit height of the slits provided in the slit plate 140, 2.0 mm, 1.0 mm, 0.2 mm and 0.1 mm other than the above 0.5 mm are tried. The slit height and the slit spacing are the same. The number of slits provided in the slit plate 140 is increased as the slit height is lowered. If the slit height is 1.0 mm or greater (if the slit height is too large), the developer B is discharged from the vicinity of the lower end of the slits (the lower end of the discharge port 134) as in the case of the developer A. The developing device 13*a* in which the slit plate 140 having a slit height of 1.0 mm or greater is provided in the discharge port 134 is in a state similar to the comparative example. The effect of the slit plate 140 is insufficient.

If the slit height is 0.1 mm (if the slit height is too small), the developer A is discharged from above the slit plate 140, similarly to the developer B. In the developing device 13*a* in which the slit plate 140 having a slit height of 0.1 mm is provided in the discharge port 134, a portion where a developer layer cannot be formed on the developing roller 132 is confirmed even if the developer A is contained.

Figure 10A:
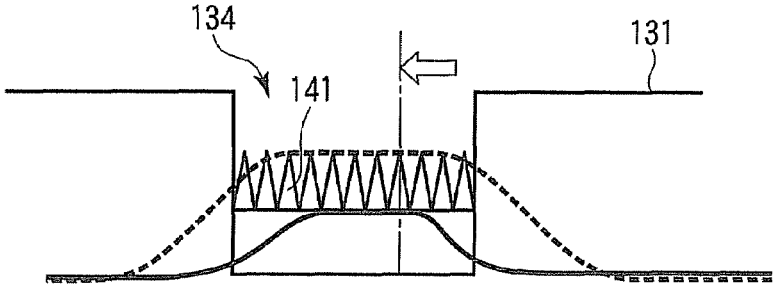
FIG. 10A is a side view of a developing device as a third embodiment.
Figure 10B:
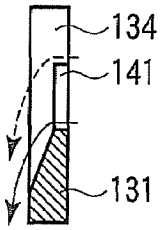
FIG. 10B is a front sectional view of the dotted chain line part in FIG. 10A, as viewed from the direction of the arrow.

Next, the developing device 13*a* according to a third embodiment will be described. FIG. 10A is a side view of the developing device 13*a*. FIG. 10B is a front sectional view in the chain dotted line in FIG. 10A as viewed from the direction of the arrow.

At the lower end of the discharge port 134 of the developing device 13*a* according to the third embodiment, a serrated plate 141 of a serrated shape is formed in which plural triangular plates are arrayed, each having a 1.0 mm-long base in the longitudinal direction of the developer tank 131 and a height of 4.0 mm in the direction of height of the developer tank 131. The upper end of the serrated plate 141 is at a position lower than the upper end of the discharge port 134. That is, the lower end of the discharge port 134 is covered by the serrated plate 141 and the upper end side of the discharge port 134 is perfectly open. The part of the serrated plate 141 covering the discharge port 134 gradually becomes smaller in the longitudinal direction of the developer tank 131 (horizontal direction), from the lower end toward the upper end of the serrated plate 141.

The serrated plate 141 according to the third embodiment has the same effect as in the case where the lower end of the discharge port 134 is raised in the direction of height with respect to the developer with lowered fluidity, similarly to the slit plate 139 according to the first embodiment. In the developing device 13*a* according to the third embodiment, as the serrated plate 141 is provided in the discharge port 134, the developer can be efficiently discharged from a space at an appropriate position in the direction of height of the serrated plate 141 even if the developer surface is raised in accordance with the fluidity at the lower end of the center of the discharge port 134. In the developer tank 131 according to the third embodiment, reduction in the amount of the developer contained in the developer tank 131 can be restrained.

Here, the indices are measured in an environment of 23° C. and 50% using the initial developer A (with a toner density of 8.5%) in the developing device 13*a* having the serrated plate 141 provided in the discharge port 134. The amount of the developer A contained in the developer tank 131 is 395 g. If the developer A is contained in the developer tank 131, the space in the direction of height between the developing roller 132 and the developer surface is substantially 6 mm.

Moreover, the indices are measured in an environment of 23° C. and 50% using the developer B after printing equivalent to 300 k sheets in the developing device 13*a* having the serrated plate 141 provided in the discharge port 134. The amount of the developer B contained in the developer tank 131 is 380 g. If the developer B is contained in the developer tank 131, the space in the direction of height between the developing roller 132 and the developer surface is 6.5 mm. The indices for the developer B are substantially the same as the indices for the developer A.

As for the base of the triangular plates provided in the serrated plate 141, 2.0 mm, 0.5 mm, 0.2 mm and 0.1 mm other than the above 1.0 mm are tried. The height of the serrated plate 141 is 4 mm in all the cases. The number of triangular plates provided in the plate 141 is increased as the length of the base of the triangular plates is shortened.

Figure 11A:
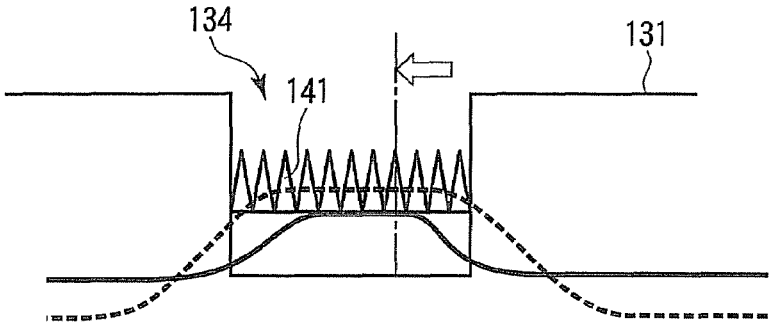
FIG. 11A is a side view showing another example of the developing device as the third embodiment.
Figure 11B:
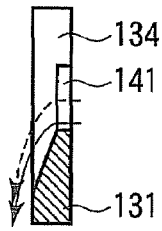
FIG. 11B is a front sectional view of the dotted chain line part in FIG. 11A, as viewed from the direction of the arrow.

FIG. 11A is a side view showing another example of the developing device 13*a* according to the third embodiment. FIG. 11B is a front sectional view in the chain dotted line in FIG. 11A as viewed from the direction of the arrow. FIG. 11A shows the developing device 13*a* in which the serrated plate 141 having triangular plates with a 2.0 mm-long base is provided in the discharge port 134. If the serrated plate 141 including triangular plates with a 2.0 mm-long base is provided in the developing device 13*a*, the developer A is discharged from the lateral side of the triangular plates on the lower end side of the serrated plate 141 (near the lower end of the discharge port 134).

Here, the indices are measured in an environment of 23° C. and 50% using the initial developer A (with a toner density of 8.5%) in the developing device 13*a* in which the serrated plate 141 shown in FIG. 11A is provided in the discharge port 134. The amount of the developer A contained in the developer tank 131 is 390 g. If the developer A is contained in the developer tank 131, the space in the direction of height between the developing roller 132 and the developer surface is substantially 6 mm.

Moreover, the indices are measured in an environment of 23° C. and 50% using the developer B after printing equivalent to 300 k sheets in the developing device 13*a* in which the serrated plate 141 shown in FIG. 11B is provided in the discharge port 134. The amount of the developer B contained in the developer tank 131 is 320 g. If the developer B is contained in the developer tank 131, the space in the direction of height between the developing roller 132 and the developer surface is substantially 9.0 mm.

If the serrated plate 141 including the triangular plates with a 2.0 mm-long base shown in FIG. 11A is provided in the developing device 13*a*, the developer B is discharged from an intermediate height in the serrated plate 141 instead of the lateral side of the triangular plates on the lower end side of the serrated plate 141 or a position above the upper end of the serrated plate 141. The developer B is discharged from a position on the serrated plate 141 that is different from the case where the serrated plate 141 having the shape shown in FIG. 10A is provided in the developing device 13*a*. The position on the serrated plate 141 where the developer B is discharged is a position where the horizontal spacing between the neighboring triangular plates is less than 1.0 mm.

The space between the developing roller 132 and the developer surface in the case where the developer B is contained in the developer tank 131 is slightly greater than the space between the developing roller 132 and the developer surface in the case where the developer A is contained in the developer tank 131. However, if the developer B is contained in the developing device 13*a*, the developer layer on the developing roller 132 is formed without any problem, as in the case of the developer A.

If the base of the triangular plates is 0.5 mm, 0.2 mm and 0.1 mm in length, the position where the developer A is discharged is higher than the lateral side of the triangular plates on the lower end side of the serrated plate 141. As the length of the base of the triangular plates constituting the serrated plate 141 is reduced, the position where the developer A is discharged becomes higher.

There is no problem in images if the base of the triangular plates constituting the serrated plate 141 is 0.5 mm and 0.2 mm in length. If the base of the triangular plates constituting the serrated plate 141 is 0.1 mm in length, where the developer A is contained in the developer tank 131, the developer surface contacts the developing roller 132. The developer A used for development is not separated from the developing roller 132. If this developer A is used again fro development, an uneven image is generated.

If the developer B is contained in the developing device 13*a*, the developer B is discharged from a position above the upper end of the serrated plate 141 irrespective of the length of the base of the triangular plates constituting the serrated plate 141. The developer layer on the developing roller 132 is formed without any problem.

Figure 12:
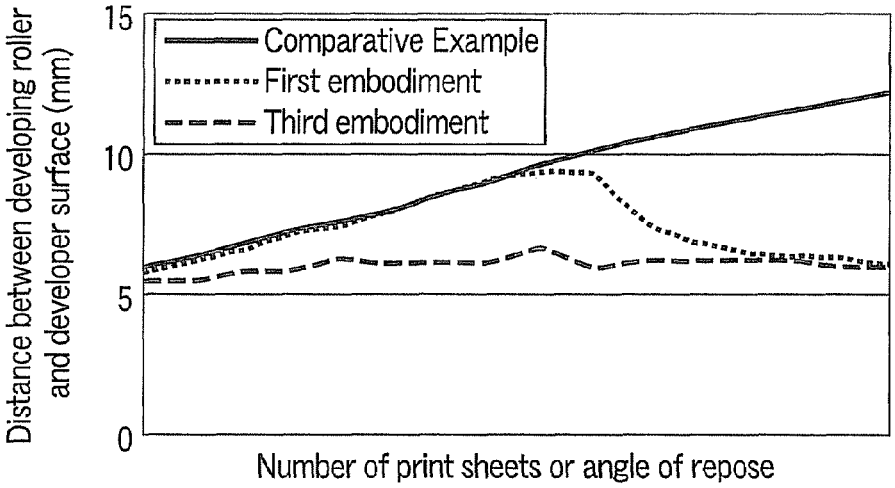
FIG. 12 is a graph showing the space between a developing roller and a developer surface in relation to the number of print sheets or the angle of repose.

FIG. 12 is a graph showing the space between the developing roller 132 and the developer surface in relation to the number of print sheets or the angle of repose. Since the number of print sheets and the angle of repose have correlation in the case of using the developer contained in the developing device 13*a*, the horizontal axis may represent either the number of print sheets or the angle of repose.

In the case of the comparative example shown in FIG. 7A, if the angle of repose of the developer is increased, the developer surface becomes higher than the lower end of the center of the discharge port 134, at the lower end of the center of the discharge port 134. The developer is discharged from the discharge port 134. Therefore, the amount of the developer contained in the developer tank 131 is reduced. Consequently, as the angle of repose of the developer is increased, the space between the developing roller 132 and the developer surface in the direction of height is increased.

As the first embodiment, if the slit plate 139 as shown in FIG. 8A is provided in the discharge port 134, the position where the developer is discharged shifts upward from the lower end of the discharge port 134 as the fluidity of the developer becomes worse than a certain level (that is, if the angle of repose reaches a certain value or greater). If the fluidity of the developer is lowered, the developer cannot be easily discharged from the slits provided in the slit plate 139. Therefore, the slit plate 139 restrains reduction of the developer contained in the developer tank 131. Consequently, it is considered that in the developing device 13*a* according to the first embodiment, the position of the developer surface facing the developing roller 132 is raised to the original position.

As the third embodiment, if the serrated plate 141 as shown in FIG. 10A is provided in the discharge port 134, the position where the developer is discharged gradually shifts upward from the lower end of the discharge port 134 in accordance with the reduction in fluidity of the developer (that is, increased in the angle of repose). If the fluidity of the developer is lowered, the developer cannot be easily discharged from the spacing in the serrated plate 141. Therefore, it is considered that in the developing device 13*a* according to the third embodiment, the space between the developing roller 132 and the developer surface is maintained to a constant space.

In the developing devices 13*a* according to the first to third embodiments, even if the developer surface rises at the lower end of the center of the discharge port 134 in accordance with the fluidity, it can be simulatively considered that the position of the lower end of the discharge port 134 substantially becomes higher because of the characteristics of the developer. The developer then cannot be easily discharged from the discharge port 134. Therefore, the space between the developing roller 132 and the developer surface is maintained to a constant space. Consequently, stable image formation can be realized.

In the first to third embodiments, the lower end of the discharge port 134 may have a flat part extending with a predetermined width in the direction of width of the developer tank 131. If the developer has normal fluidity, the developer is discharged outside the developing device 13*a* over the flat part of the discharge port 134. If the fluidity of the developer is lowered, the developer discharged from the discharge port 134 is not discharged as far as outside of the developing device 13*a* and remains on the flat part of the discharge port 134, because the angle of repose is increased if the fluidity of the developer is lowered. Therefore, the developer forms a high mound corresponding to the angle of repose on the flat part of the discharge port 134. The mount of the developer formed on the flat part of the discharge port 134 has the same effect as substantially raising the position of the lower end of the discharge port 134. The reduction of the developer contained in the developer tank 131 can be restrained.

What is claimed is:

1. A developing device comprising:

a developer tank configured to contain a developer including a toner and a carrier, the developer tank having a discharge port which is provided in a lateral side surface of the developer tank and configured to discharge the developer;

a developing agent supplier configured to develop a latent image by using the toner contained in the developer tank; and a plate-shaped member configured to be formed in a direction of height from a lower end of the discharge port and partially cover the discharge port to regulate the discharge of the developer, an upper end of the plate-shaped member being situated below an upper end of the discharge port.

2. The device of claim 1, wherein the discharge port is rectangular and the lower end of the discharge port is provided in a horizontal direction.

3. The device of claim 2, wherein the plate-shaped member has plural slits each extending in the direction of height.

4. The device of claim 3, wherein each of the plural slits has a width which is the same as a space between the plural slits in the horizontal direction.

5. The device of claim 2, wherein the plate-shaped member has plural slits each extending in the horizontal direction.

6. The device of claim 5, wherein each of the plural slits has a width which is the same as a space between the plural slits in the direction of height.

7. The device of claim 2, wherein the plate-shaped member has plural triangular plates each extending in the direction of height and arranged in the horizontal direction.

8. The device of claim 1, wherein the lower end of the discharge port is provided at a position substantially coincident with a surface position of the developer if a standard amount of initial developer is contained in the developer tank.

9. An image forming apparatus comprising:

an image carrier configured to hold a latent image;

a charger configured to uniformly charge the image carrier;

a developer tank configured to contain a developer including a toner and a carrier, the developer tank having a discharge port which is provided in a lateral side surface of the developer tank and configured to discharge the developer;

a developing agent supplier configured to develop a latent image formed on the image carrier by using the toner in the developer tank; and a plate-shaped member configured to be formed in a direction of height from a lower end of the discharge port and partially cover the discharge port to regulate the discharge of the developer, an upper end of the plate-shaped member being situated below an upper end of the discharge port.

10. The apparatus of claim 9, wherein the discharge port is rectangular and the lower end of the discharge port is provided in a horizontal direction.

11. The apparatus of claim 10, wherein the plate-shaped member has plural slits each extending in the direction of height.

12. The apparatus of claim 11, wherein each of the plural slits has a width which is the same as a space between the plural slits in the horizontal direction.

13. The apparatus of claim 10, wherein the plate-shaped member has plural slits each extending in the horizontal direction.

14. The apparatus of claim 13, wherein each of the plural slits has a width which is the same as a space between the plural slits in the direction of height.

15. The apparatus of claim 10, wherein the plate-shaped member has plural triangular plates each extending in the direction of height and arranged in the horizontal direction.

16. The apparatus of claim 10, wherein the lower end of the discharge port is provided at a position substantially coincident with a surface position of the developer if a standard amount of the developer is contained in the developer tank.

17. The apparatus of claim 9, further comprising:

a detector configured to detect a toner density of the developer contained in the developer tank; and a cartridge configured to supply the developer to the developer tank if the detector detects that the toner density is lower than a specified value.

18. A developing device comprising:

means for containing a developer including a toner and a carrier;

means for developing a latent image using the toner;

means for discharging the developer outside, the means for discharging being provided in a lateral side surface of the means for containing; and means for regulating the discharge of the developer in accordance with fluidity of the developer, the means for regulating being formed in a direction of height from a lower end of the means for discharging and partially covering the means for discharging to regulate the discharge of the developer, an upper end of the means for regulating being situated below an upper end of the means for discharging.

* * * * *